US007648380B2

(12) United States Patent
Taylor

(10) Patent No.: US 7,648,380 B2
(45) Date of Patent: Jan. 19, 2010

(54) DC PLUG CONNECTOR

(75) Inventor: Robert W. Taylor, Redhill (GB)

(73) Assignee: Cliff Electronic Components Limited, Redhill, Surrey (GB)

( * ) Notice: Subject to any disclaimer, the term of this patent is extended or adjusted under 35 U.S.C. 154(b) by 0 days.

(21) Appl. No.: 12/076,051

(22) Filed: Mar. 13, 2008

(65) Prior Publication Data

US 2008/0287001 A1 Nov. 20, 2008

(30) Foreign Application Priority Data

Mar. 18, 2007 (GB) ..... 0705142.8

(51) Int. Cl.
*H01R 13/62* (2006.01)

(52) U.S. Cl. ..... 439/312

(58) Field of Classification Search ..... 439/312, 439/825, 669, 668, 826
See application file for complete search history.

(56) References Cited

U.S. PATENT DOCUMENTS 4,526,429 A 7/1985 Kirkman
5,898,993 A * 5/1999 Inaba et al. ..... 29/874
6,533,617 B1 * 3/2003 D'Addario ..... 439/669
6,626,710 B1 9/2003 Tsai Huang

FOREIGN PATENT DOCUMENTS

| | | |
|---|---|---|
| EP | 0 923 170 A2 | 6/1999 |
| GB | 984576 | 2/1965 |
| GB | 1273811 | 5/1972 |

* cited by examiner

*Primary Examiner*—Edwin A. Leon
(74) *Attorney, Agent, or Firm*—The Nath Law Group; Jerald L. Meyer; Jiaxiao Zhang

(57) ABSTRACT

A pin connector assembly comprising a socket (11) adapted to receive a cylindrical electrical plug (12), the plug having a central longitudinal bore (17), the socket being in the form of an insulated housing having a cylindrical receptacle (13) with a pin (14) located in the centre thereof, said pin (14) being adapted to be located in the bore (17) of the plug when the plug and the socket are in mating connection, the assembly further comprising an annular resilient collar (20) adapted to fit either over the pin (14) of the socket or within the bore (17) of the plug and which compresses radially inwards when the circumference of the bore and the pin are of essentially equal size and which remains in an expanded configuration when the circumference of the bore (17) is greater than the circumference of the pin (14), thus maintaining electrical contact between the electrical plug (12) and the socket (11).

13 Claims, 4 Drawing Sheets

DC PLUG CONNECTOR

The present application relates to an improved DC plug and socket connector for low voltage AC and DC power supplies and battery chargers, most particularly for use with DC power connectors.

BACKGROUND OF THE INVENTION

Connectors for supplying direct current (DC) power are poorly standardised compared to domestic alternating current (AC) power plugs and sockets. A DC plug is a commonly used term for one type of cylindrical two-conductor plug available in a range of sizes and usually used to power small pieces of electronic equipment. The most common use of the DC plugs is on the cable connected to a power supply. The matching jack or socket is then mounted in the equipment to be powered. Several competing standards exist for DC plugs. In some cases, incompatible plugs can be fitted into sockets, possibly damaging equipment and leading to a poor current supply.

Cylindrical DC plugs generally have an insulated tip constructed to accept insertion of a pin into a bore within the plug. The outer body of the plug is one electrical contact, most often but not always the negative side of the supply. A pin mounted in the socket makes contact with the second internal contact when inserted into the bore of the plug. The outer plug contact is often called the sleeve and the inner the centre contact, although the tip itself it usually non-conductive. At least two different national standards exist, EIAG in Japan and DIN in Germany. As well as these standards, several conventions have been adopted by specific manufacturers to indicate voltage by plug size.

Contact ratings vary from less than 1 Amp up to 5 Amps with a 2 Amp current being typical. The voltage which can be supplied again varies and is usually under 100 Volts, with a 12 Volt power supply being typical.

The most common type of plug found in the art will have an approximate outside diameter (OD) of 5.5 mm and a length of 9.5 mm. However, two pin sizes are commonly used in the jacks for this size of plug body, 2.1 mm and 2.5 mm. For best electrical contact, the bore within the plug should match the diameter of the pin. However, the two sizes are very similar and can easily be confused even when seen together. The sizes are also not usually marked on either the plug or the socket.

One of the disadvantages of the conventional pin connector is the possibility of electric arcing between the pin and the bore of the inserted plug which surrounds the pin in a mating connection. The contact between the centre pin and the inserted plug relies on interference between the plug and the bore which surrounds it when the plug is inserted into the socket. In many cases, due to normal manufacturing tolerances, the dimensions between the mating parts of a socket and a plug are not precise and a bad connection is obtained as a result.

As noted above, it is difficult to distinguish a 2.5 mm DC plug from a 2.1 mm DC plug even when the plugs are seen together. The bore of a 2.1 mm DC plug is too small to fit a socket having a 2.5 mm pin. By contrast, a bore of 2.5 mm in a DC plug will fit a 2.1 mm pin, but may not make enough contact to work effectively and the contact interference between the pin and the bore may not be made sufficiently. In extreme cases, this will result in electric arcing which may product sufficient heat to induce burning. In other cases, no contact is made at all and no power supply is provided.

Various solutions have been proposed, including the provision of a locking DC connector which uses a threaded fitting to secure the connection between the plug and socket. However, such threaded systems are difficult to use with a wired DC plug. There is accordingly a need to solve the problems discussed above and to ensure that there is always a positive contact between the socket pin and the bore of the plug.

The present Applicants have now realised that by improving a socket connector to be more flexible to dimensional variations, all of the above-mentioned disadvantages can be overcome.

SUMMARY OF THE INVENTION

According to a first embodiment of the present invention, there is provided a pin connector assembly comprising a socket adapted to receive a cylindrical electrical plug, the plug having a central lengthwise bore, the socket being in the form of an insulated housing having a cylindrical receptacle with a pin located in the centre thereof, said pin being adapted to be located in the bore of the plug, the assembly further comprising an annular resilient collar adapted to fit either over the pin of the socket or within the bore of the plug and which compresses radially inwards when the circumference of the bore and the pin are of essentially equal size and which remains in an expanded configuration when the circumference of the bore is greater than the circumference of the pin, thus maintaining electrical contact between the plug and the socket.

The advantage of having a resilient contact means is that a socket having a 2.1 mm pin can receive a plug that has either a 2.1 mm or a 2.5 mm bore and thus achieve a good electrical contact without the possibility of arcing across a space between the pin and the bore.

The resilient contact means is preferably in the form of a tubular radially compressible spring and is preferably conducted of a resilient, thin, non-corrosive sheet material, e.g., copper or copper alloy, or steel such as stainless steel.

The spring may in one embodiment be fitted as a collar around the shaft of the pin. It may be possible to adapt the pin such that there is a section adapted to receive the spring behind the head of the pin. This preferred embodiment will be described in more detail in the detailed description of the invention.

According to a second embodiment of the present invention, there is provided a socket connector comprising an insulated housing having a receptacle with a pin in the centre adapted to receive a plug having a central lengthwise bore, the bore of the plug containing an annular convex tubular radially compressible collar which can maintain contact with the pin of the socket.

It can thus be understood that the spring can be located either surrounding the pin within the socket or in the bore of the plug.

DETAILED DESCRIPTION

The preferred embodiments of the present invention will be described with reference to the accompanying Figures.

Figure 1:
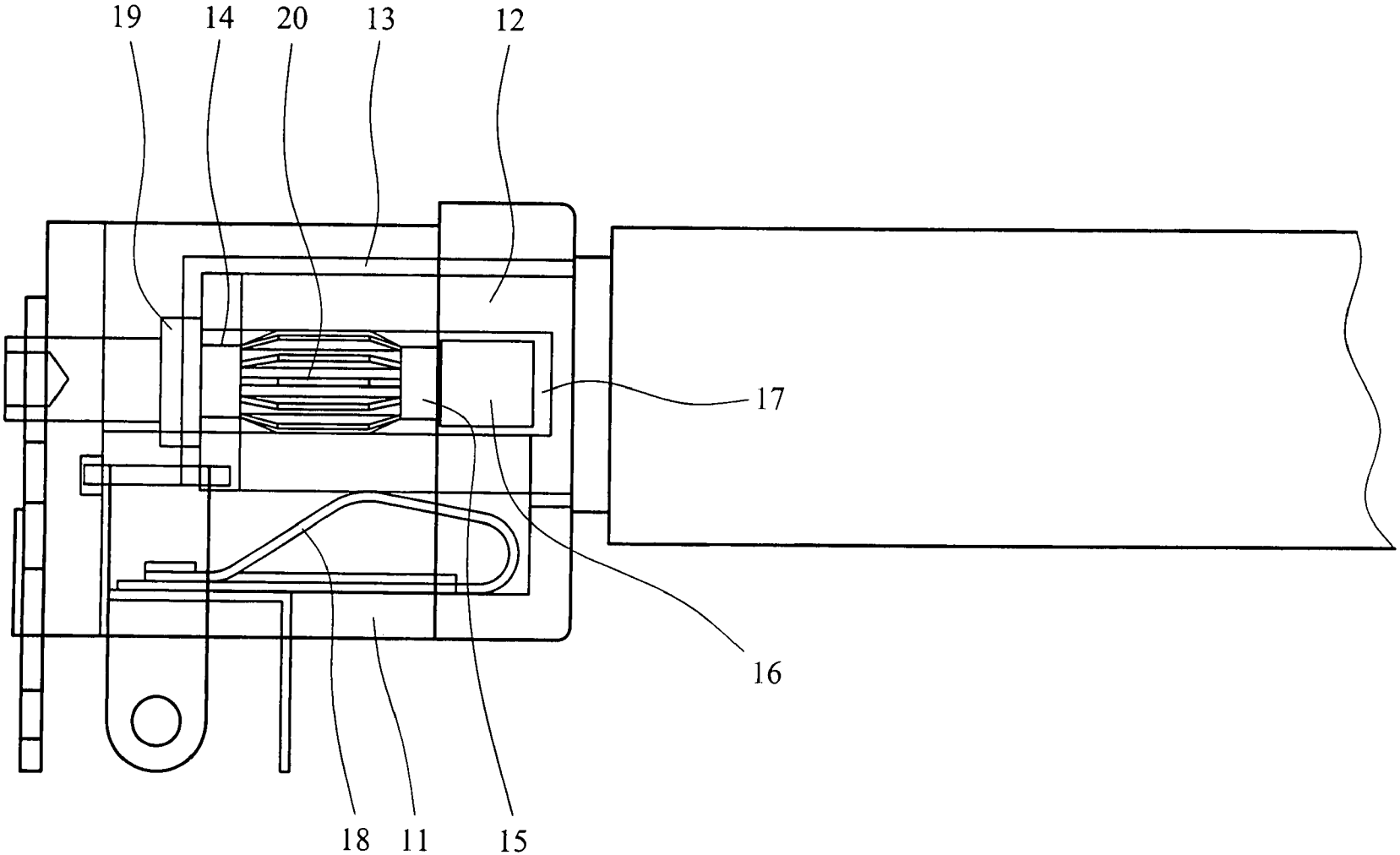
FIG. 1 is a cross-section view of the first embodiment of the present invention when in use.

The plug and socket assembly shown in FIG. 1 comprises a socket 11 adapted to receive an electrical plug 12. The socket 11 is an insulated housing having a receptacle 13 with a metallic conductive pin 14 located in the centre thereof. The pin 14 comprises a shaft 15, a head 16 and a distal collar 19. The diameter of the head of the pin 16 can vary in size but generally will be in the range of 2.0-2.5 mm, e.g., 2.1 mm or 2.5 mm. The head of the pin will preferably have a rounded configuration, facilitating entry of the pin into the bore of the plug. The shaft of the pin 15 will generally have a smaller diameter. The shaft of the pin has a diameter which is less than the diameter of the head by equal to or up to 10% more than the thickness of the spring material 21. This recessed shaft prevents the bore of the plug snagging on the collar of the spring as mating occurs. If the spring material is 0.15 mm thick and the head of the pin has a diameter of 2.1 mm, the shaft of the pin should have a maximum diameter of 1.8 mm. The pin will have a variable length, but will usually be from 7.0 to 8.5 m long. The pin may be formed of a conductive material, preferably brass. The material is preferably coated, e.g., with nickel, silver, tin or gold to give a hard-wearing, non-oxidising surface.

The electrical plug 12 has a longitudinal cylindrical bore 17 adapted to fit the pin 14 of the socket.

A standard plug and socket arrangement will have a contact spring 18 of resilient material located in the socket and adapted to compress downwards to its closed configuration when the plug 12 exerts a force on the spring 18 whilst it is inserted into receptacle 13 of the socket 11. The contact spring 18 retains the plug 12 in place when inserted the socket 11 and can also act as an electrical contact point. When the plug 12 is withdrawn from the socket 11, the resilient contact spring expands to its natural shape. One or more further contact springs may be provided in the socket if desired.

The assembly further comprises an annular tubular compressible spring structure 20 of a resilient material adapted to compress radially inwards.

Figure 2:
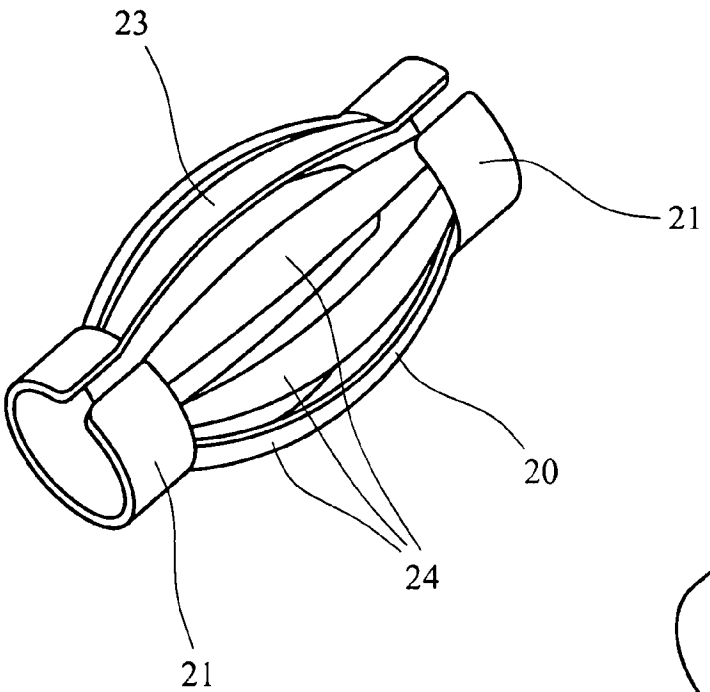
FIG. 2 is a 3-D view of the annular spring according to the first embodiment of the present invention.

FIG. 2 shows the tubular compressible spring structure 20 according to the present invention. The structure 20 comprises two collars 21 at each end adapted to fit in a retained position around the shaft of the pin 15. Between the collars 21 is located a resilient concave spring 23. This spring 23 can compress radially inwards and then expand back to its natural resting state. The spring is preferably constructed from a blank of sheet material into structure comprising a plurality of bent slats 24.

Figure 3:
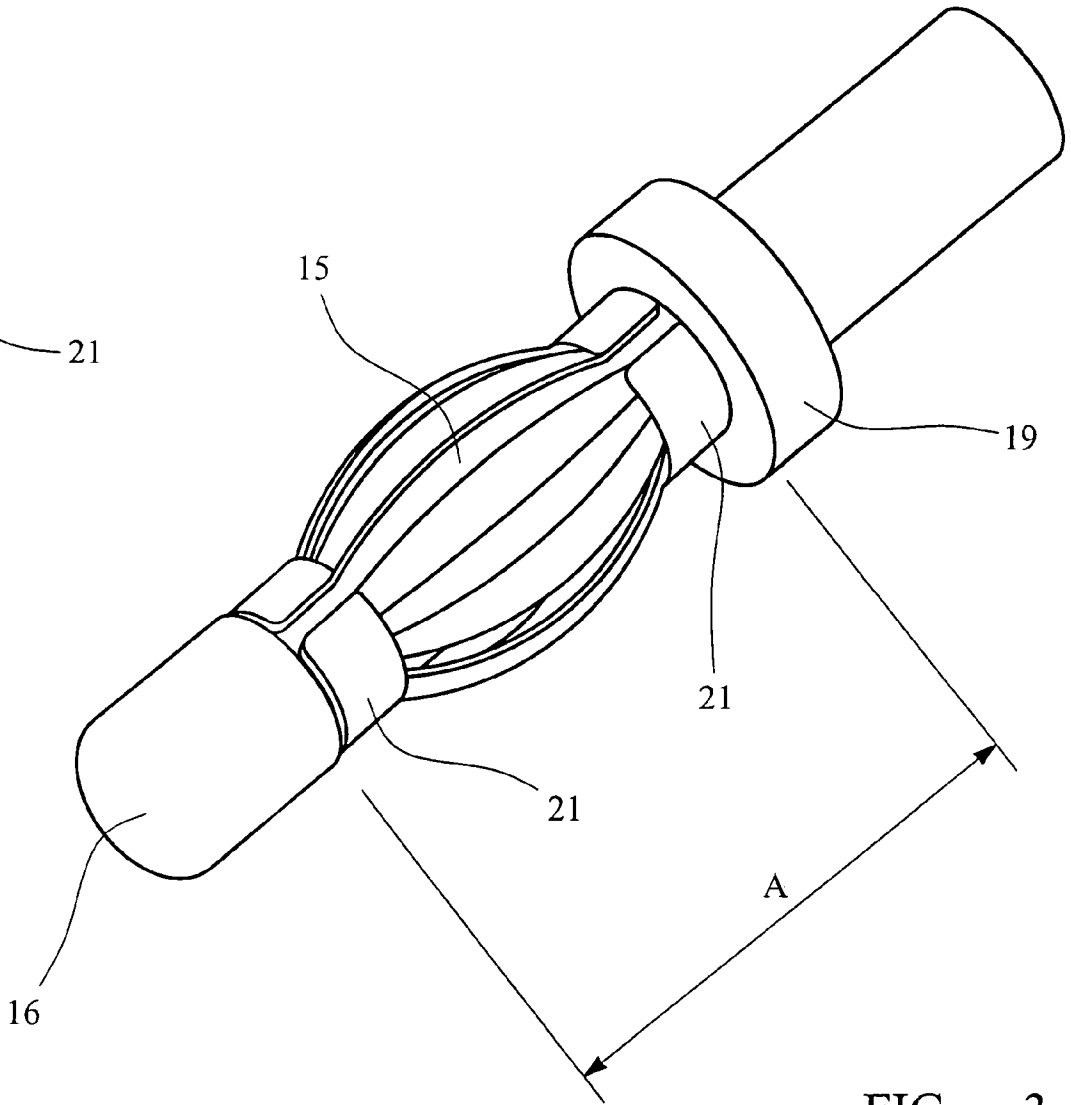
FIG. 3 is a 3-D view of the annular spring shown in FIG. 2 in assembly with the pin of the socket.

FIG. 3 shows the spring structure 20 fitted around the shaft of the pin 15.

In use, the spring 23 in its resting state adopts a convex arc around the shaft of the pin 15. When a plug 12 is inserted into the socket 11, the bore 17 of the plug fits over the head of the pin 16. If the diameter of the head of the pin and the bore of the plug are the same or within a tolerance of, for example, less than 10% of the diameter of the bore 17, then the spring will compress radially inwards to allow the pin to pass fully into the bore of the plug. A good electrical contact is then maintained between the plug 12 and the socket 11 through both the contact pin 14 and the contact spring 18.

If the diameter of the bore 17 of the plug is greater than the diameter of the head of the pin 16, then the slats 24 of the spring structure 20 will compress less, but will still help maintain contact between the surface of the bore 17 of the plug and the shaft of the pin 15. Again, a good electrical connection is maintained. Using the spring in the plug and socket assembly of the present invention, a plug having a bore of diameter 2.5 mm may be inserted into a socket which has a pin of diameter 2.1 mm. The spring makes the contact over the space between the pin and the bore. Therefore, a 2.1 mm pin can work effectively with both a 2.1 mm bore plug and a 2.5 mm bore plug. Thus, it is not critical what size of plug is used as both 2.1 mm and 2.5 mm plugs are usable with a 2.1 mm pin.

The spring structure 20 may be made of a suitable metal conductive material, e.g., copper or steel. The preferred material is a beryllium/copper alloy. The spring can be plated after formation, for example with nickel, silver or gold. The spring structure may be made from a piece of sheet material cut and rolled to an appropriate shape and then hardened. The material of the spring may be in the order of 0.1 to 0.3 mm, preferably 0.15 mm. The spring structure 20 is held in place on the shaft of the pin 15 between the head of the pin 16 and the collar of the pin 19. Although the longitudinal length (A) of the spring structure 20 may be the same as the longitudinal distance between the head of the pin 16 and the collar of the pin 19, it is preferable that the spring is made slightly shorter in order to ensure that the spring can compress. However, if the spring is formed into a slatted structure 24 then the length of the spring structure will not extend during compression.

Figure 4:
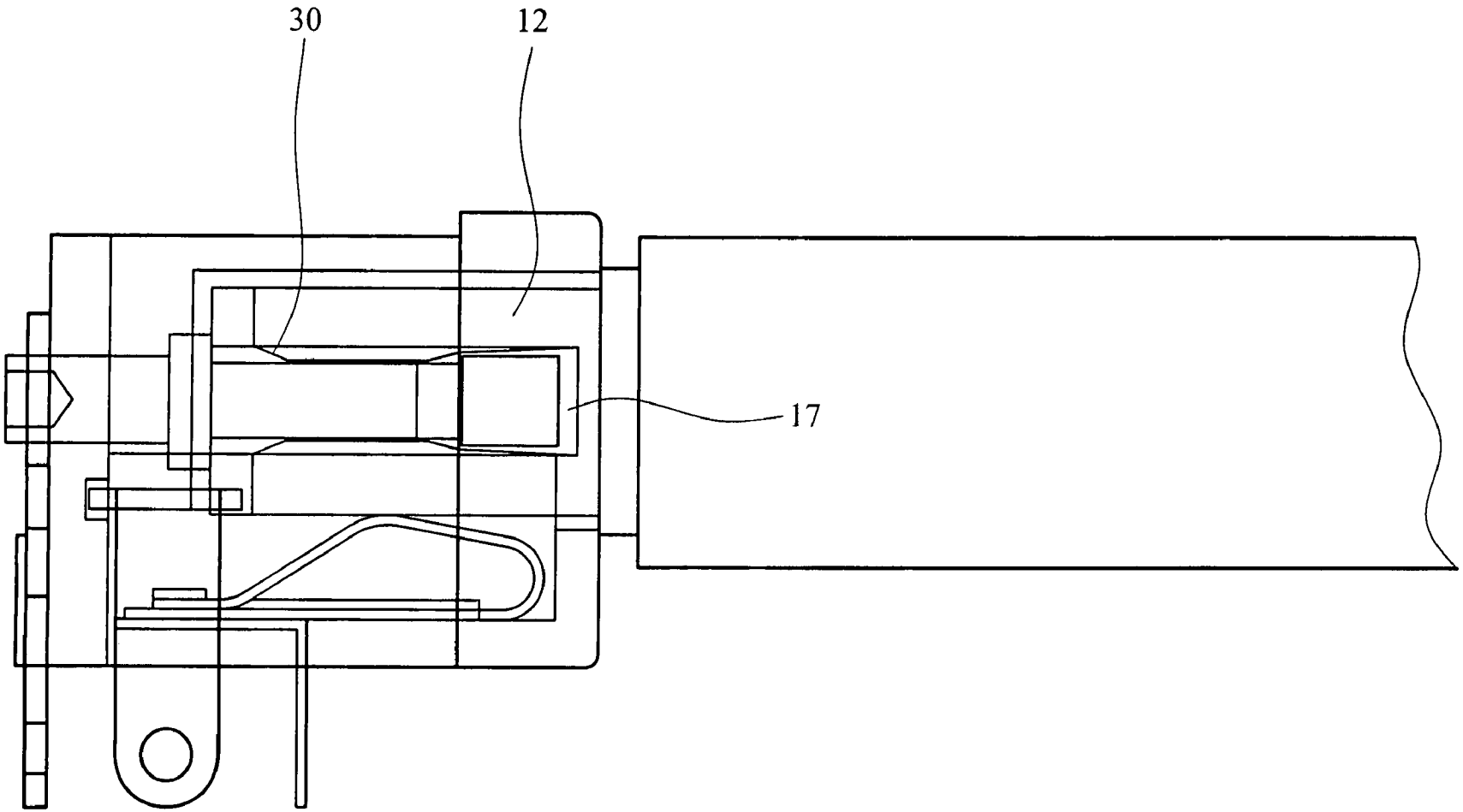
FIG. 4 is a cross-section view of the second embodiment of the present invention when in use.
Figure 5:
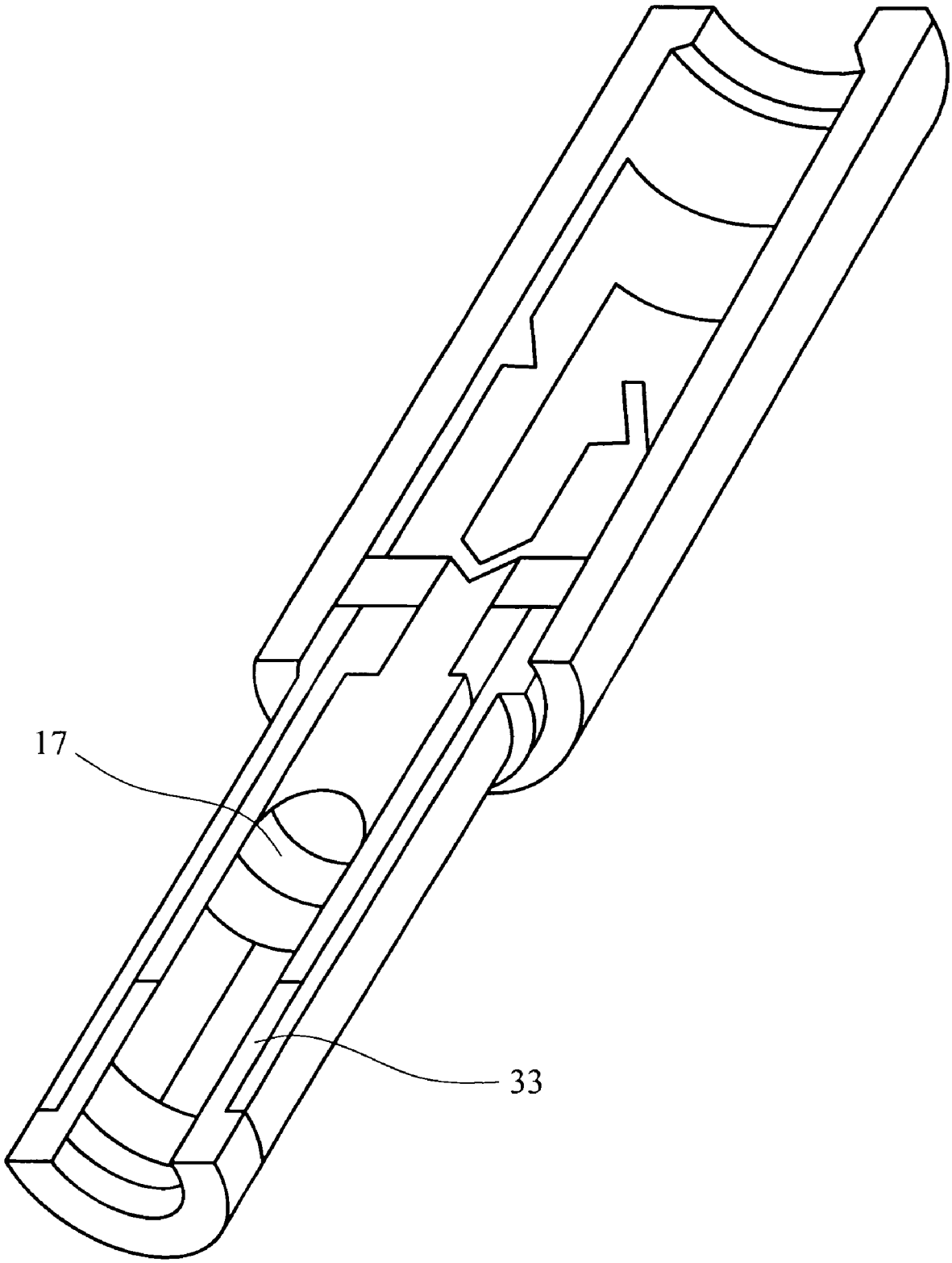
FIG. 5 is a 3-D cutaway view of the annular spring according to the second embodiment of the present invention in location in the bore of a plug.

FIG. 4 shows an alternative embodiment of the invention wherein the spring structure 30 is located in the bore 17 of the plug 12. The spring structure 30 is effectively the inverted version of the spring structure shown in FIG. 2. The structure 30 comprises two collars 31 at each end adapted to fit firmly into the bore of the plug 17. Between the collars 31 of the spring is located a resilient convex spring 33. This spring can compress radially inwards and then expand back to its natural resting state. The spring is preferably constructed of a plurality of bent slats 34. The spring structure 30 is located into the bore 17 of the plug by the force of the spring collars 31 acting against the wall of the bore 17.

In the second embodiment, the spring 33 in its resting state adopts an arc expanding into the bore 17 of the plug. When the plug 12 is inserted into the socket 11, the bore 17 of the plug fits over the head of the pin 16. If the diameter of the head and the bore of the plug are the same or within a tolerance of, for example, less than 10% of the diameter of the bore 17, then the spring will compress radially inwards to allow the pin to pass fully into the bore of the plug. A good electrical contact is then maintained between the plug 12 and the socket 11.

However, if the diameter of the bore 17 of the plug is wider than the diameter of the pin 14, then the spring 33 of the spring structure 30 will compress less, but will still help to maintain contact between the bore 17 of the plug and the shaft of the pin 15. Again, a good electrical connection is maintained.

Although the above discussion has generally described the present invention according to specific embodiments, one of ordinary skill in the art would recognise other variants, modifications and alternatives in the light of the foregoing discussions.

I claim:

1. A pin connector assembly comprising:

a cylindrical electrical plug, the plug having a central longitudinal bore;

a socket configured to receive the cylindrical electrical plug, the socket comprising an insulated housing having a cylindrical receptacle with a pin located in the centre thereof, the pin configured to be located in the bore of the plug when the plug and the socket are in mating connection; and an annular resilient collar configured to fit either over the pin of the socket or within the bore of the plug, the annular resilient collar compressing radially inwards when the circumference of the bore and the pin are of essentially equal size and the annular resilient collar remaining in an expanded configuration when the circumference of the bore is greater than the circumference of the pin, thus maintaining electrical contact between the electrical plug and the socket.

2. A pin connector assembly as claimed in claim 1 wherein the annular resilient collar comprises a tubular radially compressible spring.

3. A pin connector assembly as claimed in claim 1 wherein the annular resilient collar is formed from resilient, thin, non-corrosive sheet material selected from copper or steel or alloys of copper or steel.

4. A pin connector assembly as claimed in claim 1 wherein the pin is formed from a conductive material.

5. A pin connector assembly as claimed in claim 4 wherein the conductive material is brass.

6. A pin connector assembly as claimed in claim 4 wherein the conductive material is coated with a material selected from nickel, silver, tin and gold.

7. A pin connector assembly as claimed in claim 1 wherein the annular resilient collar is configured to fit over the pin of the socket.

8. A pin connector assembly as claimed in claim 7 wherein the pin comprises a head, a shaft and a collar located distally from the head, the diameter of the shaft being less than the diameter of the head.

9. A pin connector assembly as claimed in claim 8 wherein the annular resilient collar is located over the shaft of the pin and is held in place between the head of the pin and the collar of the pin.

10. A pin connector assembly as claimed in claim 1 wherein the annular resilient collar is located in the bore of the plug.

11. A pin connector assembly as claimed in claim 1 wherein the annular resilient collar is formed from a metal blank having longitudinal slots cut thereinto and rolled into a tubular shape.

12. A pin connector assembly as claimed in claim 11 wherein the annular resilient collar comprises two end collars separated by a resilient concave spring.

13. A pin connector assembly as claimed in claim 11 wherein the annular resilient collar comprises two end collars separated by a resilient convex spring.

* * * * *